United States Patent [19]

Black

[11] Patent Number: 4,488,815

[45] Date of Patent: Dec. 18, 1984

[54] SLURRY RECLAMATION METHOD

[76] Inventor: Melvin L. Black, 610 Big Bend Dr., Pacifica, Calif. 94044

[21] Appl. No.: 463,741

[22] Filed: Feb. 4, 1983

[51] Int. Cl.[3] ..... B28C 7/04

[52] U.S. Cl. ..... 366/8; 366/17

[58] Field of Search ..... 366/1, 2, 6, 8, 16, 366/17, 18, 40, 140, 143, 160, 162, 348

[56] References Cited

U.S. PATENT DOCUMENTS 4,226,542 10/1980 Black et al. ..... 366/17

*Primary Examiner*—Robert W. Jenkins
*Assistant Examiner*—Arthur D. Dahlberg
*Attorney, Agent, or Firm*—Townsend and Townsend

[57] ABSTRACT

In a one hundred percent slurry reclamation installation, the design mix of the concrete is adjusted by measuring the specific gravity of a slurry to be substituted, selecting the percentage of slurry to be substituted for the fresh concrete mix design ingredients, computing the amount of water, sand and active cement in the slurry from the relative amounts of active and passive solids in the slurry and the slurry specific gravity, and reducing the design values of water, cement and sand by the computed amounts when admixing the slurry to the reduced quantities of fresh ingredients. The amount of slurry water, slurry sand and slurry cement to be substituted, respectively, for the fresh water, fresh sand and fresh cement are each computed and these computed amounts are used to reduce the design mix amounts in accordance with specific mathematical relationships, which ensure that the quality of the concrete produced, as measured by slump, water/cement ratio and yield, is substantially the same as concrete produced according to the same design mix from entirely fresh ingredients.

The process is implemented in existing control console equipment normally coupled to the batching console of a ready-mix plant.

11 Claims, 2 Drawing Figures

SLURRY RECLAMATION METHOD

BACKGROUND OF THE INVENTION

This invention relates to cement slurry reclamation techniques for ready-mix concrete plants in which the aggregate and coarse sand constituents are separated from returned concrete mix and the remaining ingredients are stored in slurry form for total consumption during the following production day.

U.S. Pat. No. 4,226,542 issued Oct. 7, 1980, for "Cement Slurry Reclamation System and Method", the disclosure of which is hereby incorporated by reference, illustrates a slurry reclamation system for use with a concrete ready-mix plant which enables one hundred percent reclamation of the constituents of concrete mix returned to the plant site by vehicles. Returned concrete mix is dumped into an inlet hopper having a screw classifier for removing aggregate and coarse sand, and a weired channel enabling gravity flow of the water, cement fines and sand fines constituents into a slurry vessel. The slurry vessel is sized in such a manner as to guarantee complete consumption of the slurry returned during a day's production by the end of the following production day, the volumetric capacity of the vessel being related to the total average volume of water used to produce fresh concrete during a representative production day.

The slurry is consumed by admixture to fresh water, cement, sand and aggregate at a rate selected in accordance with the slurry specific gravity and the scheduled or estimated production requirements for that particular day. As disclosed more fully in the above-referenced patent, the percentage of slurry to be admixed to the fresh ingredients is selected by the operator and determined by the slurry vessel working level volume, the measured specific gravity of the slurry (typically obtained at the beginning of the production day) and the scheduled day's production. Typically, the operator manually selects a programmed amount of cement, sand, aggregate and water by weight into a set point controller physically incorporated in the batching console in the ready-mix plant, the amounts being determined by the operator in accordance with the concrete design mix figures normally used by the operator. Next, the set point amounts of these ingredients are then modified or compensated for in accordance with the percentage of slurry activity (a predetermined figure), the specific gravity obtained from a density cell and the percentage of slurry substitution obtained from the day's production schedule. It should be noted that the set amount of the aggregate by weight is normally unaffected by the slurry values, since the slurry ordinarily contains no aggregates. The batch controls for cement, water, sand and aggregate are then used to meter the relative amounts of the constituent ingredients from the water supply and the storage bins for the dry ingredients to the ready-mix mechanism.

SUMMARY OF THE INVENTION

This invention comprises an improvement over the one hundred percent slurry reclamation technique disclosed in the above-referenced U.S. patent, which results in improvement in the quality of concrete produced while maintaining one hundred percent recycling of all returned concrete.

In the most general aspect, the invention comprises a method for adjusting the design mix of concrete to substitute slurry formed by mixing returned concrete and water for design values of water, cement and sand while maintaining substantially constant the yield and water/cement ratio of the concrete. The method proceeds by determining the specific gravity of the slurry; establishing the percentage of slurry to be substituted for fresh cement mix constituent ingredients; computing the amount of water, sand and active cement in the slurry from the relative amounts of active and passive solids in the slurry and also from the slurry specific gravity; and reducing the design values of water, cement and sand by the amounts computed. The design value reduction is preferably performed automatically without operator intervention.

The computation of the water, sand and active cement amounts in the slurry includes the step of compensating for moisture in the sand design value, the compensation being performed after the sand design value has been reduced by the computed amount of sand in the slurry.

The water in the slurry is computed by multiplying the total slurry amount by the fractional portion representing liquids (normally water alone) in the slurry. The sand in the slurry is computed by multiplying the total slurry by the fractional portion representing non-active slurry solids and also by the fractional portion representing all solids in the slurry. Preferably, the slurry sand computation is adjusted by further multiplying the total slurry by a correction factor representing the ratio of the specific gravity of the sand to the specific gravity of the cement. The amount of cement in the slurry is computed by multiplying the total slurry by the fractional portion representing active slurry solids and also by the fractional portion representing all solids in the slurry.

The total slurry is computed by subtracting the amount of moisture in the sand design value from the total water design value, and dividing this result by a value obtained by multiplying the fractional portion of the slurry representing liquids by the slurry substitution percentage, multiplying the percentage moisture in the sand by the fractional portion representing non-active slurry solids and also by the fractional portion representing all solids in the slurry and subtracting the result, and adding to the two multiplicative results the fractional portion representing all liquids in the slurry.

The fractional portion representing all solids in the slurry is obtained by subtracting a value representing the product of the specific gravity of water and the specific gravity of the slurry solids from the determined value of the slurry specific gravity, and dividing the resulting difference by a value representing the product of the determined value of the slurry specific gravity and the specific gravity of the slurry solids minus 1.0.

By automatically reducing the design values of water, cement and sand by the computed amounts and substituting slurry for portions of the water, cement and sand in accordance with the method of the invention, maximum usage of the recycled constituent ingredients from the slurry is obtained without sacrificing quality of the concrete produced, particularly with reference to the slump, water/cement ratio, yield and compressive strength.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
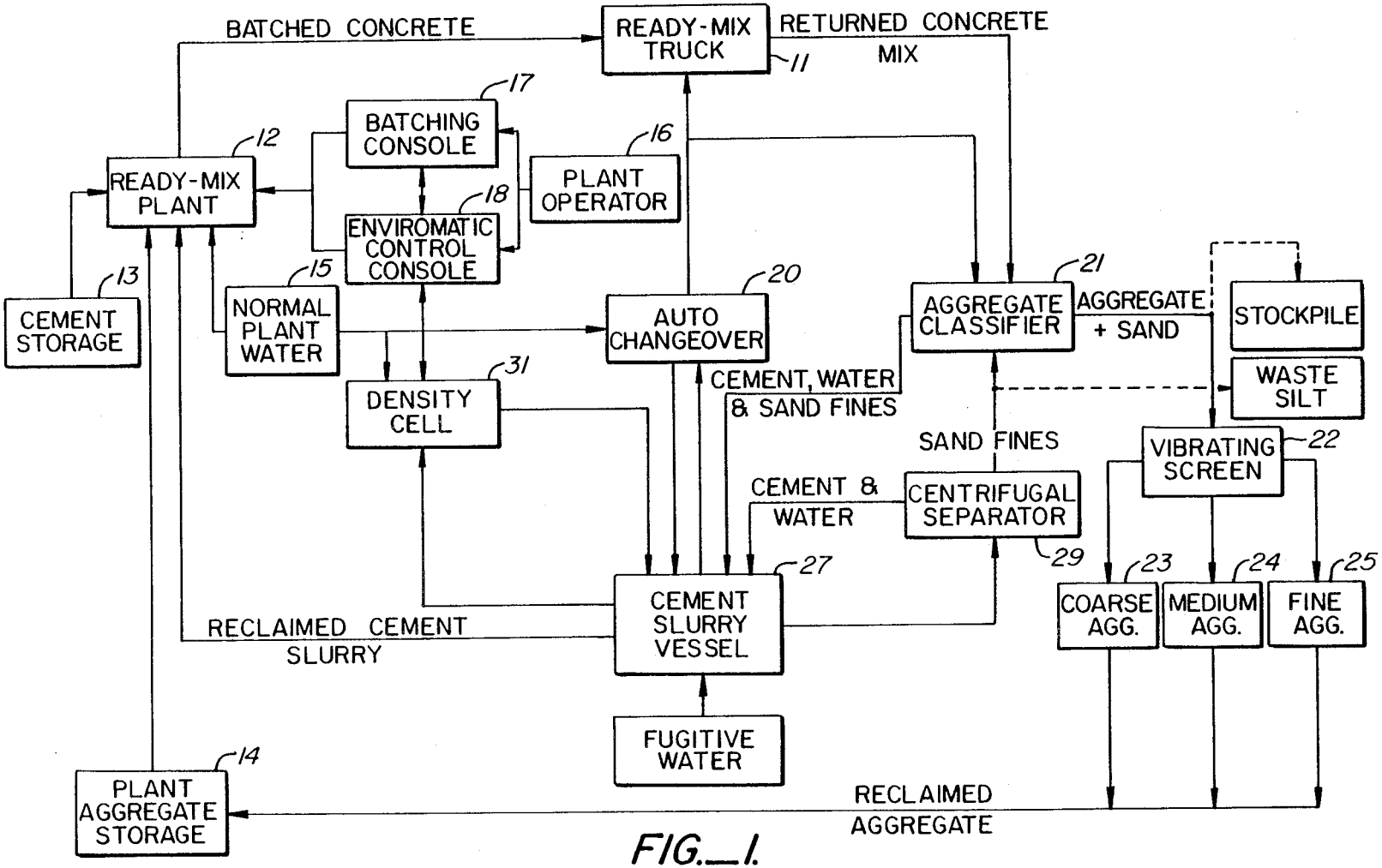
FIG. 1 is a block diagram of a one hundred percent slurry reclamation system in which the invention is implemented.

Turning now to the drawings, FIGS. 1 illustrates a one hundred percent slurry reclamation system in which the invention is implemented. As seen in this figure, a ready-mix truck station 11 is provided for loading of batched concrete from a ready-mix plant 12 to which mix materials are supplied from a cement storage unit 13, a plant aggregate storage unit 14 and a normal plant water supply unit 15, all under control of a plant operator normally located at a station 16, who controls a batching console 17 and a density controlling device 18. Plant 12 and cement storage units 13 and 14 may comprise any conventional arrangement known to those skilled in the art and found in ready-mix concrete yards. Similarly, the plant water supply unit 15 and batching console 17 are conventional units known to those skilled in the art. The density controlling device 18 is preferably an Enviromatic unit of the type sold by Challenge-Cook Bros., Inc. of Industry, Calif. and comprises a multi-function unit for controlling the amount of washout water supplied to a truck at station 11, for sequencing pump motors and other motors associated to the several system components at the concrete yard to minimize electrical power consumption, and for controlling back flushing of predetermined fluid conduits at the end of a production day.

The ready-mix truck station 11 is provided with truck washout water supplied from a normal plant water supply 15 or a cement slurry vessel 27 via an auto changeover unit 20 described in detail in the above-referenced patent. Returned concrete mix from the ready-mix truck station 11 is also coupled to an aggregate classifier unit 21, which preferably comprises a dewatering screw classifier of known design.

Aggregates and coarse sand separated from the aggregate classifier unit 21 are supplied via an optional vibrating screen unit 22, also conventional, to coarse, medium and fine aggregate temporary storage hoppers 23–25, from which the separated and classified aggregate components are transported periodically to the plant aggregate storage unit 14 via any suitable means, e.g. separate conveyor belts. Alternatively, the separated aggregates may simply be stockpiled, as indicated by the broken line.

The returned concrete mix minus the separated aggregate and coarse sand is coupled from aggregate classifier unit 21 to a cement slurry vessel 27. Water is supplied to vessel 27 from the normal plant water unit 15 via auto changeover unit 20 and also by drainage of fugitive water (e.g. ground water from the truck washout operation, storm water and the like) into the vessel 27 by appropriate drain channels.

The slurry in vessel 27 is coupled to a density cell 31 on demand from the plant operator at station 16. Density cell 31 may comprise any one of a number of known density measuring units capable of providing a static or dynamic density reading upon demand. The slurry in vessel 27 is also connected to the ready-mix plant 12 for use in concrete fabrication in the manner described below.

In operation, at the beginning of each production day at the ready-mix yard, the plant operator at station 16 initiates operation of the ready-mix plant 12 by manipulating the various controls on the batching console 17. If fresh batched concrete is to be produced without the addition of any slurry from vessel 27, or if no slurry remains in the vessel 27, the batched concrete supplied to the ready-mix truck station 11 is fresh concrete produced from the proper design mix of dry cement in storage unit 13, aggregate from storage unit 14 and water supplied from normal plant water unit 15. The fresh batched concrete is then supplied to the ready-mix truck station 11. As an empty truck becomes available, each truck is filled and driven to the job site where the truck is emptied. As each truck returns to the truck station 11, it is typically reloaded with additional freshly batched concrete. At the end of the production period, typically late in the afternoon, each truck returns to station 11 wherein the concrete mix residue is washed out and supplied to the aggregate classifier unit 21. During wash out, either fresh water from the normal plant water unit 15 or clarified water from the vessel 27 is supplied to the truck station 11 via the auto change over unit 20, depending on whether sufficient clarified water is present in vessel 27. This same water is also supplied to the aggregate classifier unit 21 to separate the cement and sand fines from the aggregates in the returned concrete mix.

The mixture of cement, water and sand fines from aggregate classifier unit 21 flows into the vessel 27; the returned aggregate and coarse sand from classifier unit 21 are deposited on a vibrating screen 22, in which the returned aggregate-sand combination is separated into two or more sizes depicted in FIG. 1 as coarse, medium and fine. After separation, the reclaimed aggregate is transported to the plant aggregate storage unit 14 for reuse.

The mixture of returned cement and sand fines, as well as the water, deposited in the vessel 27 is periodically cycled through a centrifugal separator 29 in order to remove the sand fines therefrom. The remaining cement and water mixture is then returned to the vessel 27, while the sand fines are coupled to the classifier unit 21 for separation and reuse, or deposited as waste silt in a separate location.

When a slurry is present in the vessel 27 and when the plant operator opts to use reclaimed slurry in combination with fresh mix, the plant operator at station 16 initially measures the specific gravity of the slurry using density cell 31. In addition, the scheduled quantity of cement to be batched during that day's production period (or the operator's estimate thereof) is also used to determine the percentage of reclaimed slurry to be added to the fresh mix, the object being to completely empty the slurry from vessel 27 before the end of the day's production period. Further, the percent slurry activity, which is a predetermined figure of merit available to the operator obtained by known laboratory procedures for slurries of different specific gravities, is the remaining value selected by the operator for use in determining the amount of slurry to be admixed to the fresh ingredients.

Figure 2:
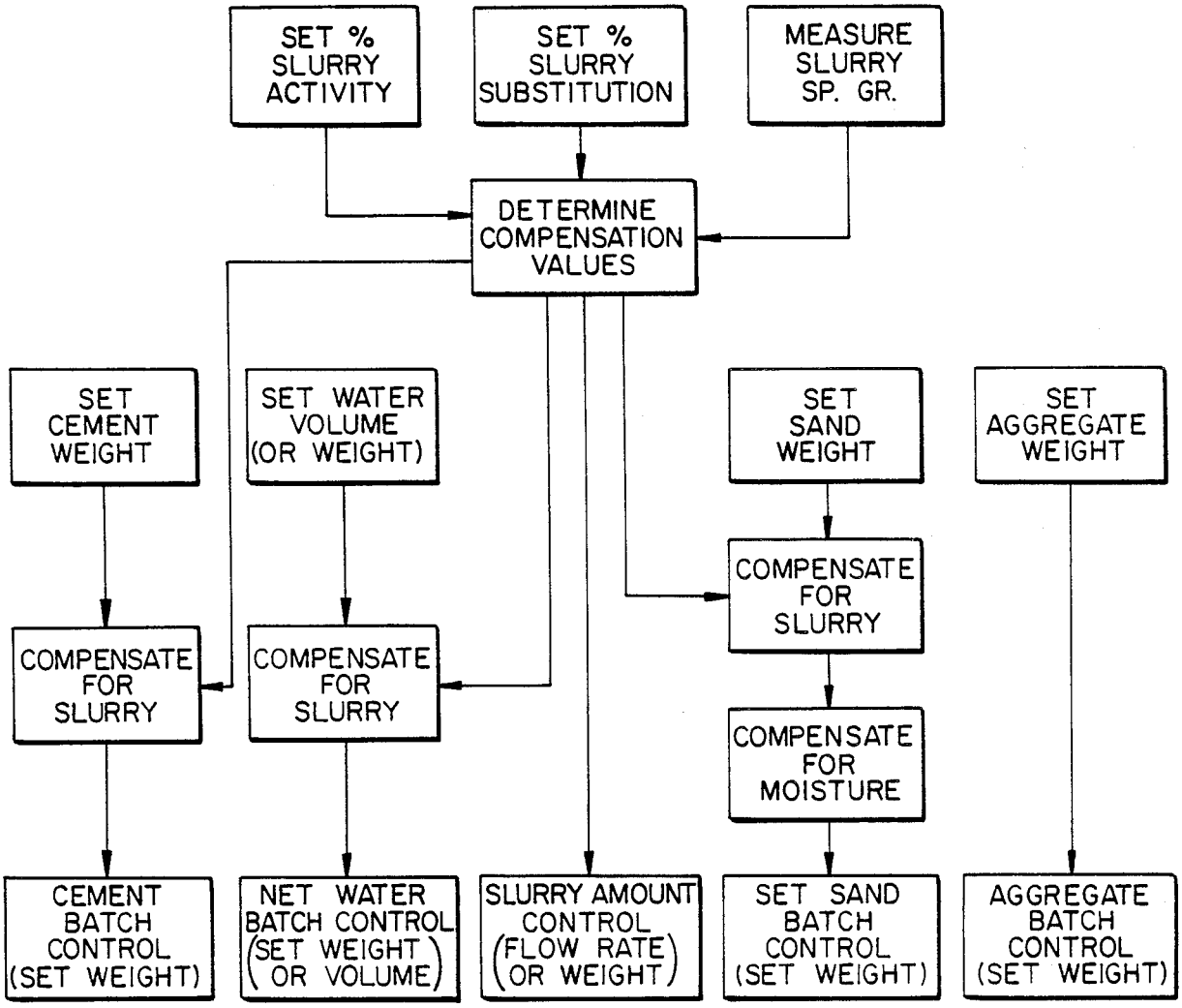
FIG. 2 is a flow chart illustrating the slurry reclamation process in accordance with the invention.

With reference to FIG. 2, the method of the invention proceeds initially with operator selection of percent slurry activity, percent slurry substitution and the measured or determined value of the slurry specific gravity. The operator next specifies the design value for the cement, pure water, sand and aggregate constituents of a particular concrete design mix.

The first three parameters are then used in calculating compensation values for the design values of the cement (set cement weight), pure water (set water weight), and sand (set sand weight). After the compensation calculations have been performed automatically, the cement, pure water and sand design values are reduced by the compensating amounts of the corresponding ingredients present in the slurry in the course of the batching process and a compensating amount of slurry is pumped from the vessel 27 to the ready-mix plant 12 for admixture to the compensated amounts of the fresh ingredients.

The compensating values are computed in accordance with the invention in the following manner. The total amount of water in the slurry is obtained by multiplying a quantity termed the total slurry by the fractional portion of the slurry representing liquids alone using the following mathematical relationship:

$$\text{Water in slurry} = \text{total slurry} \cdot \left(1 - \frac{\%\ \text{solids}}{100}\right) \tag{1}$$

The total amount of sand in the slurry is obtained by multiplying the total slurry by the fractional portion representing non-active slurry solids and by the fractional portion representing all solids in the slurry, in accordance with the following mathematical relationship:

$$\text{Sand in slurry} = \text{total slurry} \cdot \left(1 - \frac{\%\ \text{activity}}{100}\right) \cdot \left(\frac{\%\ \text{solids}}{100}\right) \tag{2}$$

The total amount of cement in the slurry is obtained by multiplying the total slurry by the fractional portion representing active slurry solids and by the fractional portion representing all solids in the slurry in accordance with the following mathematical relationship:

$$\text{Cement in slurry} = \text{total slurry} \cdot \left(\frac{\%\ \text{Activity}}{100}\right) \cdot \left(\frac{\%\ \text{solids}}{100}\right) \tag{3}$$

The three compensating values (i.e. water, sand and cement in slurry) are then subtracted from the total water, total sand and total cement design values (i.e. the set weights) and the total slurry is added to these lowered fresh ingredient values. The total slurry value is obtained by subtracting the amount of moisture in the sand design value from the total water design value, and dividing this result by a value obtained by multiplying the fractional portion of the slurry representing liquids by the slurry substitution percentage, multiplying the percentage moisture in the sand by the fractional portion representing non-active slurry solids and by the fractional portion representing all solids in the slurry and subtracting the result, and adding the fractional portion representing all liquids in the slurry to the result, all in accordance with the following mathematical relationship:

$$\text{Total slurry} = \left[\text{total water} - \left(\text{total sand} \cdot \frac{\%\ \text{moisture}}{100}\right)\right] \div \left[\left(1 - \frac{\%\ \text{solids}}{100}\right) \cdot \left(1 - \frac{\%\ \text{subsitution}}{100}\right) + \frac{\%\ \text{solids}}{100}\right) - \left(\frac{\%\ \text{solids}}{100}\right) \cdot \left(1 - \frac{\%\ \text{acivity}}{100}\right) \cdot \left(1 - \frac{\%\ \text{solids}}{100}\right)\right] \tag{4}$$

The value of the percentage moisture in the sand is a measured value obtained from the sand stook pile stored in the plant aggregate storage unit 14. The fractional portion representing all solids in the slurry is a calculated value obtained by subtracting the product of the specific gravity of water and the specific gravity of slurry solids (usually assumed to be 3.15) from the measured value of the slurry specific gravity, dividing this value by another value obtained by multiplying the measured slurry specific gravity by the specific gravity of solids minus 1.0, and multiplying the quotient by a normalization factor of one hundred, all in accordance with the following mathematical relationship:

$$\%\ \text{solids} = 100 \cdot \frac{[\text{slurry specific gravity} - (\text{Water Specific Gravity} \cdot \text{Solids Specific Gravity})]}{[(\text{Solids Specific Gravity} - 1) \cdot \text{Slurry Specific Gravity}]} \tag{5}$$

For completeness, the following mathematical relationships express the individual contributions from the various ingredients which together make up the total design value of the water, sand and cement for the concrete mixture:

$$\text{Total Water} = \text{Fresh batched water} + \text{Water in Slurry} + \text{Sand Moisture} \tag{6}$$

$$\text{Total Sand} = \text{batch sand}\left(1 + \frac{\%\ \text{sand moisture}}{100}\right) + \text{Slurry Sand Solids} \tag{7}$$

$$\text{Total Cement} = \text{Batched Cement} + \text{Active Cement Solids in Slurry} \tag{8}$$

As a comparison of the above equations demonstrates, the slurry compensation amounts applied to the set weights for the cement, water and sand for a particular design mix not only result in a savings of cement, pure water and stock piled sand, but also leaves unaffected the water/cement ratio, which is a significant figure of merit when measuring the quality of concrete. Further, from tests conducted on cement produced in accordance with the method of the invention, it has been determined that the slump is substantially unaffected when preparing concrete in accordance with the invention. In addition, the design mix yield also remains essentially constant when preparing concrete in accordance with the invention, the yield being measured by comparing the total design weight per cubic yard with the actual weight per cubic yard of concrete fabricated in accordance with the invention.

The following is an example showing the difference in values of the amount of cement, pure water, and sand which would be consumed by preparing a concrete mixture with a particular mixture design, and by preparing the same yield (pounds per cubic yard) of concrete using the invention. It should be emphasized that the quality of the concrete, as measured by slump and cement/water ratio, of the slurry substituted mixture is substantially the same as the design mix.

| GIVEN MIX DESIGN 1 CUBIC YARD | |
|---|---|
| Total $H_2O$ SSD | 320# |
| Total Sand SSD | 1356# |
| Total Cement | 564# |
| Rock | 1779# |
| Flyash | None |
| Admixs | None |
| Total Weight | 4019.00#/CU |
| Water Cement Ratio | .57 |

| GIVEN OPERATION CONDITIONS | |
|---|---|
| Sand Moisture | 6% |
| Percent Substitution | 50% |
| Percent Activity of Slurry | 50% |
| Specific Gravity of Slurry | 1.20 |

THE BATCH MAN ENTERS THE FOLLOWING INFORMATION TO HIS AUTOMATIC BATCHING CONSOLE:

1—Mix design
2—Cu. yds. required
3—Sand moisture
4—Percent Substitution of Cold or Hot $H_2O$ for cement slurry
5—Percent Activity of cement slurry
6—Specific gravity of cement slurry IF THE BATCH MAN ELECTS TO BYPASS SLURRY FOR CERTAIN LOADS HE SIMPLY ENTERS ZERO FOR SUBSTITUTION LIKEWISE IF HE ELECTS TO COMPENSATE ONLY THE SAND HE ENTERS ZERO FOR ACTIVITY AND SHOULD HE WISH TO USE SLURRY AND NOT COMPENSATE FOR THE SOLIDS HE ENTERS ZERO FOR SPECIFIC GRAVITY.

THE ACTUAL BATCH WEIGHTS FOR THE ABOVE OPERATING CONDITION ARE (1 CU. YD. WTS.)

| | |
|---|---|
| Batch Slurry | 211.86 |
| Batch $H_2O$ | 80.06 |
| Batched Sand | 1409.94 |
| Batched Cement | 538.13 |
| Batched Rock | 1779.00 |
| Total Weight | 4019.00 |
| Water Cement Ratio | .57 |

In some applications of the invention, it has been found that the assumed value of the specific gravity of the slurry solids used in calculating the percentage of solids in the slurry results in a slightly different yield from the design mix. In such cases, a correction factor may be applied to formula two above by multiplying the computed value of the sand in the slurry by a correction factor comprising the quotient of the specific gravity of sand and the specific gravity of cement, i.e. modifying the sand in slurry formula by adding the following multiplicative factor:

$$\frac{\text{Specific Gravity of Sand}}{\text{Specific Gravity of Cement}} \quad (9)$$

The invention may be readily implemented by those having ordinary skill in the art of computer programming in those ready-mix plant installations in which the control console 18 is based on a computer or a microcomputer by preparing the appropriate routines to carry out the computations noted above. If desired, equivalent analog circuitry may also be used to perform the equivalent computations, although a digital implementation is believed to be more practical and is thus preferred.

While the above provides a full and complete disclosure of the preferred embodiment of the invention, various modifications, alternate constructions and equivalents may be employed without departing from the true spirit and scope of the invention. For example, in some ready-mix plant installations, a water trim override control is provided, which enables the operator to vary the set water amount in order to vary the slump of the concrete. In such installations, the water trim override control should be inserted in the system in such a manner that the water trim is performed after compensation of the set water amount. In addition, in other installations a provision is made to compensate for moisture in the set aggregate amount. In such installations, the amount of aggregate moisture compensation should be added into the equation for the total water (equations (6)). Therefore, the above description should not be construed as limiting the scope of the invention, which is defined by the appended claims.

What is claimed is:

1. A method for adjusting the design mix of concrete by substituting a slurry, formed by mixing returned concrete and water, for design values of water cement and sand while maintaining substantially constant the yield and water/cement ratio of the concrete, said method comprising the steps of:

(a) determining the specific gravity of said slurry;
(b) establishing the percentage of slurry to be substituted for fresh concrete mix;
(c) computing the amount of water, sand and active cement in said slurry from the relative amounts of active and passive solids in said slurry and the specific gravity of said slurry, said step of computing including a step of calculating the total slurry amount by subtracting the amount of moisture in the sand design value from the total water design value, and dividing this result by a value obtained by the steps of (a) multiplying the fractional portion of the slurry representing liquids by the slurry substitution percentage; (b) multiplying the percentage moisture in the sand by the fractional portion representing non-active slurry solids and by the fractional portion representing all solids in the slurry; and (c) subtracting the result obtained in step (b) from the result obtained in step (a) and adding the fractional portion representing all liquids in the slurry; and
(d) reducing the design values of water, cement and sand by the corresponding slurry amounts computed in step (c).

2. The method of claim 1 wherein said step (c) of computing includes the step of compensating for moisture in the sand design value.

3. The method of claim 2 wherein said step of compensating is performed after the sand design value has been reduced by the amount computed in step (c).

4. The method of claim 1 wherein said step of computing the amount of water in said slurry is performed by multiplying the total slurry amount by the fractional portion representing liquids in said slurry.

5. The method of claim 1 wherein said step of computing the amount of sand in said slurry is performed by multiplying the total slurry by the fractional portion representing non-active slurry solids and by the fractional portion representing all solids in the slurry.

6. The method of claim 5 wherein said step of computing the amount of sand in said slurry further includes the step of multiplying the total slurry by a correction factor representing the ratio of the specific gravity of the sand to the specific gravity of the cement.

7. The method of claim 1 wherein said step of computing the amount of cement in said slurry is performed by multiplying the total slurry amount by the fractional portion representing active slurry solids and by the fractional portion representing all solids in the slurry.

8. The method of claims 5 or 7 wherein the fractional portion representing all solids in the slurry is obtained by subtracting a value representing the product of the specific gravity of water and the specific gravity of the slurry solids from the determined value of the slurry specific gravity, and dividing the resulting difference by a value representing the product of the determined value of the slurry specific gravity and the specific gravity of the slurry solids minus 1.0.

9. A method for adjusting the design mix of concrete by substituting a slurry, formed by mixing returned concrete and water, for design values of water, cement and sand while maintaining substantially constant the yield and water/cement ratio of the concrete, said method comprising the steps of:

(a) determining the specific gravity of said slurry;

(b) establishing the percentage of slurry to be substituted for fresh concrete mix;

(c) computing the amount of sand in said slurry by multiplying the total slurry by a fractional portion representing non-active slurry solids, a fractional portion representing all solids in the slurry, and a correction factor representing the ratio of the specific gravity of the sand to the specific gravity of the cement; and (d) reducing the design value of sand by the amount computed in step (c).

10. A method for adjusting design mix of concrete by substituting a slurry, formed by mixing returned concrete and water, for design values of water, cement and sand while maintaining substantially constant the yield and water/cement ratio of the concrete, said method comprising the steps of:

(a) determining the specific gravity of said slurry;

(b) establishing the percentage of slurry to be substituted for fresh concrete mix;

(c) computing the amount of sand in said slurry by multiplying the total slurry by the fractional portion representing non-active slurry solids and by a fractional portion representing all solids in the slurry, said fractional portion representing all solids in the slurry being obtained by subtracting a value representing the product of the specific gravity of water and the specific gravity of the slurry solids from the determined value of the slurry specific gravity, and dividing the resulting difference by a value representing the product of the determined value of the slurry specific gravity and the specific gravity of the slurry solids minus 1.0; and (d) reducing the design value of sand by the amount computed in step (c).

11. A method for adjusting the design mix of concrete by substituting a slurry, formed by mixing returned concrete and water, for design values of water, cement and sand while maintaining substantially constant the yield and water/cement ratio of the concrete, said method comprising the steps of:

(a) determining the specific gravity of said slurry;

(b) establishing the percentage of slurry to be substituted for fresh concrete mix;

(c) computing the amount of cement in said slurry by multiplying the total slurry amount by a fractional portion representing active slurry solids and by a fractional portion representing all solids in the slurry, the fractional portion representing all solids in the slurry being obtained by subtracting a value representing the product of the specific gravity of water and the specific gravity of the slurry solids from the determined value of the slurry specific gravity, and dividing the resulting difference by a value representing the product of the determined value of the slurry specific gravity and the specific gravity of the slurry solids minus 1.0; and (d) reducing the design value of cement by the amount computed in step (c).

* * * * *